United States Patent [19]

Paul

[11] 4,063,855

[45] Dec. 20, 1977

[54] COMPRESSOR CAPACITY AND LUBRICATION CONTROL SYSTEM

[75] Inventor: Kermit D. Paul, Bethlehem, Pa.

[73] Assignee: Fuller Company, Catasauqua, Pa.

[21] Appl. No.: 682,295

[22] Filed: May 3, 1976

[51] Int. Cl.[2] ..... F01C 21/04; F04C 29/02; F04B 39/02; F01M 1/00

[52] U.S. Cl. ..... 418/84; 418/85; 418/87; 418/88; 418/97; 418/100; 417/228; 184/6.16

[58] Field of Search ..... 418/84, 85, 87, 88, 418/97–100; 417/26–28, 281, 295, 228; 184/6.16

[56] References Cited

U.S. PATENT DOCUMENTS

| | | | |
|---|---|---|---|
| 3,191,854 | 6/1965 | Lowler et al. | 418/88 |
| 3,448,916 | 6/1969 | Fraser | 417/295 |
| 3,482,768 | 12/1969 | Cirrincione et al. | 417/26 |
| 3,542,497 | 11/1970 | Chapuis | 418/84 |
| 3,582,233 | 6/1971 | Bloom | 417/295 |
| 3,653,191 | 4/1972 | Nelson et al. | 417/295 |

*Primary Examiner*—John J. Vrablik
*Attorney, Agent, or Firm*—Frank H. Thomson

[57] ABSTRACT

A compressor capacity control and lubrication system including a nonmodulating capacity regulator for an oil flooded gas compressor such as a rotary screw compressor. The system includes an on-off intake regulator. The lubrication system insures sufficient supply of cooling and sealing lubrication when the machine is operating at loaded conditions and a limited quantity of cooling lubrication when the machine is operating at unloaded conditions. This is accomplished by the use of a pair of gas-liquid reservoirs. One of the reservoirs is vented to atmosphere during unloaded operation of the compressor. Lubricant is supplied from both reservoirs to the compressor when the machine is operating at loaded conditions, but only one of the reservoirs when operating at unloaded conditions.

6 Claims, 2 Drawing Figures

COMPRESSOR CAPACITY AND LUBRICATION CONTROL SYSTEM

BACKGROUND OF THE INVENTION

This invention relates to rotary compressors and more particularly to rotary gas compressors which employ the principle of injecting a lubricant into the compressor to both cool the compressor and provide a seal within the compressor. The invention is particularly applicable to gas compressors commonly known as screw compressors.

Prior to the present invention it was known to compress gas by rotating a pair of meshing lobed rotors within a casing and supplying lubricant to that casing for maintaining a seal between the rotors and cooling the machine. An early disclosure showing such an arrangement is that shown in U.S. Pat. No. 3,073,513, issued to W. Bailey.

Also known prior to the present invention was the need to regulate the output of a gas compressor. It is common practice in the gas compressor art to provide a receiver storage tank at the outlet of the compressor. For example, if the compressor is being used to supply 100 psi air the compressor will operate until the pressure in the storage tank reaches or is slightly above the 100 psi level. At that point the compressor will conventionally be "unloaded" by closing or reducing the size of the gas inlet of the compressor so that the amount of air compressed by the machine will be reduced. The compressor will operate in this manner until the storage tank falls below the desired level of 100 psi at which time the compressor inlet will again be opened and the compressor will operate in a "loaded" condition.

With many types of compressors, the inlet of the compressor is controlled by an intake regulator which is an open-closed or on-off regulator. With this type of regulator, when the machine is being operated in a loaded condition, the intake regulator fully opens the compressor inlet and the compressor operates at full capacity. When the compressor is being operated in an unloaded condition the intake regulator closes the compressor inlet and the compressor operates at essentially zero capacity. The use of an on-off type intake regulator has the advantage that when the compressor is being operated in an unloaded condition, no gas to be compressed is supplied to the inlet of the compressor and as a result, no gas is being compressed and the only work being done by the driving motor is to simply turn the machine. As a result there is a substantial power saving during unloaded operation. Thus, with an on-off intake regulator operation of the compressor is either at a fully loaded or fully unloaded condition.

Various attempts have been made to devise modulating regulators wherein as the demands on the compressor decrease, there is a gradual closing of the compressor intake to thereby achieve a gradual reduction in the output of the machine. With oil flooded screw compressors it has been common practice to use a modulating regulator which throttles the compressor intake as shown in U.S. Pat. No. 3,105,630 and others, or to use a slide valve such as shown in U.S. Pat. Nos. 3,088,659 and 3,314,597 as well as many others. Although a modulating regulator which throttles the compressor intake has resulted in an adequate control of capacity it has not resulted in a reduction of the power consumed by the machine. This is because the motor still operates to drive the compressor and work is still being done within the compressor. As a result, in most cases where suction throttling is used the power consumption of a screw compressor is reduced by only 25% to 30% even when the compressor delivery is reduced to zero; i.e., operating at fully unloaded conditions. Where a slide valve is used, the delivery of the compressor cannot normally be reduced to zero and the power consumption is reduced by only about 50%.

One of the problems encountered in using an on-off intake regulator with a screw compressor is with the lubrication system which is necessary with a screw compressor. With oil flooded screw compressors, some lubricant must be continuously supplied to the compressor for lubrication and cooling purposes even while running unloaded. However, if too much lubricant is supplied to the machine, the amount of power consumed is not reduced the desired amount. In addition, many lubrication systems for screw compressors rely on the air pressure in a receiver separator tank or a full capacity pump taking its suction from the receiver separator tank to supply lubricant to the compressor. If this receiver separator tank is not vented, air which is in the compressor must be forced against the full pressure of the receiver separator and the power requirements of the machine in the unloaded condition will not be reduced the desired amount. If a full capacity pump is used to supply lubricant to the compressor, the receiver separator tank could be vented, but this is usually a large tank and venting this tank for purposes of capacity control would be impractical.

Various control systems for screw compressors are known in the prior art wherein on-off intake regulators are employed. On such arrangement is shown in U.S. Pat. No. 3,482,768 to Cirrincione et al, wherein a receiver separator is vented and a reduced amount of lubricant is supplied to the machine during unloaded operation. A valve arrangement is shown for reducing the lubricant supplied to the machine during unloaded conditions. In addition, a purge system is used during unloaded operation to remove lubricant from the compressor. The arrangement shown in this patent was also generally known prior to that invention as illustrated by U.S. Pat. No. 2,234,462 to Boldt, wherein a metering pump is used to supply lubricant to the compressor and the oil reservoir is vented during unloaded operation to reduce the lubricant supplied to the compressor during unloaded operation. Similarly, U.S. Pat. No. 2,458,284 shows a valving mechanism for reducing coolant supplied to a compressor when the machine is operating at unloaded conditions or reduced capacity.

Also in the prior art is U.S. Pat. No. 3,936,249 issued to Sato which shows an oil flood screw compressor employing an on-off type intake regulator. In this apparatus power consumption is allegedly reduced by the compressor operating against a reduced pressure at its discharge. Apparently, however, there is no reduction in the lubricant supplied to the compressor during unloaded operation. Thus, the power consumed during unloaded operation is not reduced as much as would be desired. One disadvantage is that the time required to unload each of the prior art compressors is significant. In actual field conditions, a compressor may load and unload as often as four times a minute. With this frequency of loading and unloading, in order to achieve a real power savings, it is necessary for the actual unloading to take place in a very brief period of time. With the present invention, it is believed that the power requirements of the machine can be reduced to 25% of loaded power almost instantaneously and to 15 - 20% based upon energy consumed by the motor in a matter of 3 to 4 seconds.

SUMMARY

It is therefore the principal object of this invention to provide a capacity control system for a rotary compressor which will achieve a substantial power usage reduction over prior practices.

It is a further object of this invention to provide a gas compressor lubrication system which permits the use of an on-off type compressor intake regulator.

It is another object of this invention to provide a gas compressor system which permits rapid unloading of the compressor.

It is a still further object of this invention to provide a lubrication system for a gas compressor which substantially reduces the quantity of lubricant supplied to the compressor when the machine is operating at unloaded conditions.

The foregoing and other objects will be carried out by providing a gas compressor system comprising a rotary gas compressor having an inlet for gas to be compressed, a lubricant inlet and a compressed gas and lubricant outlet; an intake regulator for opening and closing the inlet for gas to be compressed of the gas compressor; a first pressurized gas-lubricant reservoir flow connected to the compressed gas and lubricant outlet of the gas compressor; a second pressurized gas-lubricant reservoir flow connected to said first gas-lubricant reservoir, means for selectively supplying lubricant from said second gas-lubricant reservoir to the lubricant inlet of the gas compressor; means for supplying lubricant from said first gas-lubricant reservoir to the lubricant inlet of the gas compressor; and means for venting the first gas-lubricant reservoir to atmosphere when said intake regulator is closed.

BRIEF DESCRIPTION OF THE DRAWINGS

The invention will be described in connection with the annexed drawing wherein.

DESCRIPTION OF THE PREFERRED EMBODIMENT

Figures 1, 2:
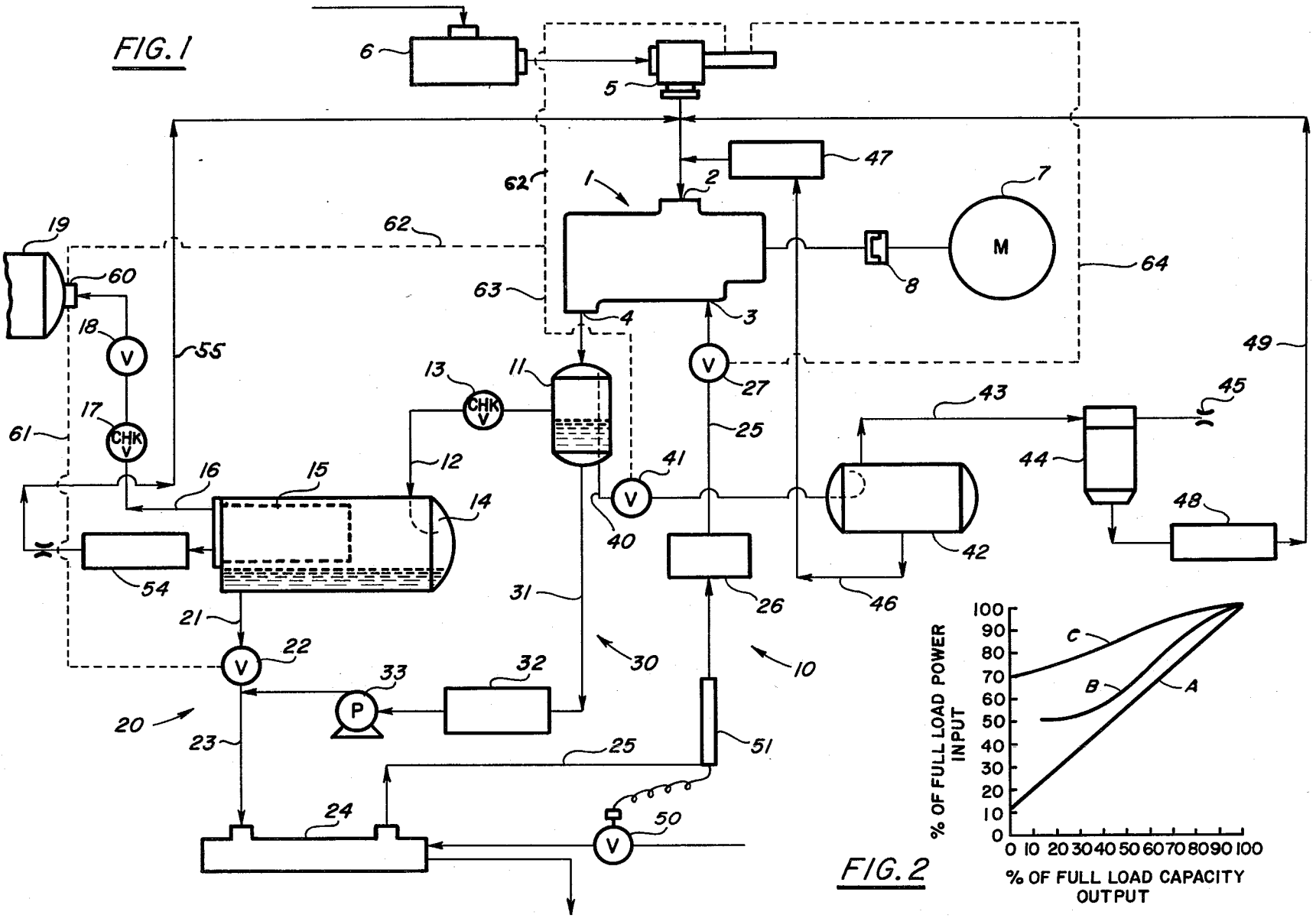
FIG. 1 is a diagrammatic view of the control system of the present invention.
FIG. 2 is a graph of the comparing power requirements to capacity for the present invention and for prior art modulating regulators.

Referring to FIG. 1, there is shown a rotary gas compressor generally indicated at 1. This may be an oil flooded screw compressor of the type shown in U.S. Pat. No. 3,773,444 or any other compressor which uses the injection of lubricant into the compressor for the purpose of cooling and lubricating the machine. The compressor includes an inlet 2 for gas to be compressed, an inlet 3 for lubricant and an outlet 4 for compressed gas and lubricant. The lubricant inlet 3 may take the form of injection ports as is well known in the art. An intake regulator 5 of any well known design is mounted on and connected to the compressor intake 2. This intake regulator is of the on-off type. The intake regulator will completely close the inlet 2 when the compressor 1 is to be operated at an unloaded condition and will completely open the inlet 2 when the compressor 1 is to be operated at loaded conditions. An inlet filter 6 may be flow-connected to the intake regulator 5 so that gas to be compressed is filtered prior to being supplied to the compressor 1.

The compressor is suitably driven by a motor 7 such as an electrical motor or diesel engine through a coupling 8.

The gas compressor of the present invention includes a system generally indicated at 10 for supplying lubricant to the lubricant inlet 3. This system includes a first source of lubricant 11 which is flow-connected to the discharge 4 of the compressor 1. A conduit 12 having a check valve 13 flow-connects the reservoir 11 to a second source of lubricant 14 which takes the form of a second gas-liquid reservoir. The location of conduit 12 will determine the normal liquid level in the tank 11 and the tank 11 is dimensioned and the conduit 12 positioned so that lubricant normally fills approximately one half the tank. The reservoir 14 is a typical receiver/separator tank for a compressor and may include a filter 15 for removing substantially all of the lubricant from the air discharged from the compressor. An outlet conduit 16 extends from the receiver/separator 14 through a check valve 17 and minimum pressure valve 18 to an external storage tank partially shown at 19. From the storage tank, compressed air will be drawn for the desired use.

The system 10 for supplying lubricant to the compressor includes means 20 for selectively supplying lubricant from the second source 14 to the lubricant inlet 3. This means includes a conduit 21 connected to the bottom of the tank 14, valve means 22 for preventing lubricant from being supplied from the tank 14 to the inlet 3, a conduit 23, oil cooler 24, conduit 25, oil filter 26 and an oil restricter valve 27 within conduit 25.

The lubricant supply system 10, also includes a means 30 for supplying lubricant from the first source 11 to the lubricant inlet 3. This means includes a conduit 31 connected to the bottom of the tank 11, a strainer 32 and a pump 33. This means 30 also includes the conduits 23 and 25 and the oil cooler 24 and oil filter 26 and the oil restricter valve 27. The pump 33 may be operatively connected to the motor 7 for continuous operation or driven by a separate motor.

The control system of the present invention includes a means for venting to atmosphere the first source 11 of lubricant during unloaded operation of the compressor 1. This is accomplished by a conduit 40 extending into the tank. and opening above the normal level of liquid in the tank 11 This system also includes a valve means 41 in conduit 40 which opens and closes to permit or prevent communication between the air portion of tank 11 and a surge tank 42. The surge tank communicates through a conduit 43 and filter 44 with atmosphere through an orifice 45. A conduit 46 communicates with the bottom of the surge tank 42 and supplies oil separated from the vented air in surge tank 42 to a filter 47 and the inlet 2 of the compressor. A strainer 48 flow connects the oil outlet of the filter 44 with the inlet 2 of the compressor through a conduit 49 so that oil separated in the filter 44 is returned to the compressor. The orifice 45 insures that the flow capacity of filter 44 is not exceeded.

The oil cooler 24 may be controlled by a water inlet valve 50 which is controlled by a temperature sensing bulb 51 in conduit 25. Oil collected in filter 15 is returned to the compressor inlet 2 through strainer 54, a restriction and conduit 55.

During operation of the compressor, when the compressor 1 is at rest, the valve 22 is closed to prevent lubricant from being supplied from the second source 14 to the lubricant inlet 3. The valve 41 is open so that the first source 11 communicates with atmosphere tnrough conduit 40, surge tank 42, conduit 43 and orifice 45. The intake regulator 5 is open and the oil pump 33 is at rest. The motor 7 is started and simultaneously the pump 33 is started so that the compressor begins to rotate and the pump 33 draws lubricant from the first source 11 through conduit 31 and strainer 32 and forces the lubricant through conduit 23, cooler 24, conduit 25, filter 26, and valve 27 to the inlet 3 for lubricant. At the same time, the valve 41 closes to prevent the venting of the first source of lubricant 11 and valve 22 opens thereby permitting oil flow from the second source of lubricant 14 to the inlet 3. The combined oil flow from source 11 and source 14 is that required by the compressor during loaded operation. Because the inlet 2 is now open, gas to be compressed is drawn into the compressor mixed with oil injected at inlet 3 and compressed therein. Compressed gas and lubricant are discharged from the compressed gas outlet 4 into the first gas liquid reservoir 11. A certain amount of lubricant is mechanically separated within the tank 11 at start-up due to the directional change in liquid flow. Compressed gas and lubricant mixture flow from the tank 11 through conduit 12 and valve 13 to the second gas-lubricant reservoir 14. Substantially, all of the remaining lubricant mixed with the gas is removed from the gas therein.

As the pressure in the tank 14 builds up to a predetermined minimum, the valve 18 permits compressed gas to be discharged from the tank 14 to the external receiver/storage tank. The pressure in the gas liquid storage tank 14 forces lubricant out of this tank through conduit 21, valve 22, and the rest of the means 20 for supplying lubricant from the second source 14 to the lubricant inlet 3. This lubricant, plus that being pumped through the means 30 for supplying lubricant from the first source 11 to the lubricant inlet 3 by the pump 33 is sufficient to cool, lubricate and seal the compressor 1 during loaded operation.

When the pressure in the external reservoir 19 reaches the desired level, the pressure is sensed by any well known means such as a pressure sensor 60. A signal is transferred from sensor 60 through any suitable electrical, mechanical or pneumatic means 61 to valve 22 to thereby close valve 22. The closing of valve 22 prevents the flow of lubricant from the first source 14 to the lubricant inlet 3. A signal is also transferred from sensor 60 through any suitable electrical, mechanical or pneumatic means 62 to intake regulator 5 to thereby close regulator 5 slightly after but almost simultaneously with the closing of valve 22. The closing of regulator 5 prevents gas from continuing to flow through it and the gas intake 2. Slightly after the closing of intake regulator 5 but almost simultaneously, a first valve means 41 opens to vent the first gas-lubricant reservoir 11 to atmosphere through surge tank 42 and orifice 45. This valve may be operated by any suitable arrangement such as a pneumatic, electric or mechanical means connected directly to sensor 60 or as designated by dotted line 63 through means 62. The check valve 13 prevents the reservoir 14 from being vented to atmosphere. This is important in that it insures that as soon as the compressor is again loaded and the valve 22 opens, there is pressure in the receiver separator 14 to force additional lubricant through system 20 to lubricant inlet 3. Only the small tank 11 needs to be repressurized. Thus the time for reloading the compressor is almost instantaneous.

The pump 33 is sized so that it supplies sufficient lubricant to the compressor 1 through the means 30 for supplying lubricant from the first source 11 to the lubricant inlet 3 during unloaded operation. This amount of lubricant is substantially less than is required during loaded operation. Since the inlet 2 is closed and the outlet 4 at atmospheric pressure, the only work being done by the compressor is that required to rotate the machine. It is believed that the power required will drop between 80% and 85% so that the amount of power used during unloaded operation will be from 15% to 20% of the power used during loaded operation. Since many compressors operate more than half the time at unloaded conditions, this will result in a substantial power savings.

An oil restricter valve 27 has been included in the conduit 25 to prevent the pressure in the pressure in the oil cooler 24 and oil filter 26 from dropping excessively while running unloaded. This minimizes oil flow surges when valve 22 opens as the compressor reloads. This valve provides full flow of lubricant therethrough during loaded operation and partial oil flow therethrough during unloaded operation. This valve may be a normally open, pilot operated valve of any well known design operated by a pilot line 64 from the intake regulator 5. The valve includes a fixed by-pass orifice which is matched to the tube oil pump 33 capacity to maintain pump discharge pressure at approximately one half to three-quarters of the normal loaded pressure. The present invention can be operated without valve 27, but this valve adds further control over the lubrication system. When it is included in the system, it preferably opens and closes at the same time as regulator 5.

When the pressure in vessel 19 sensed by sensor 60 drops below the desired pressure because of use of air in the receiver/storage tank, valve 22 will be opened the intake regulator 5 will open inlet 2 and valve 41 will be closed. Now the tank 11 is no longer vented to atmosphere and the air supplied to the inlet 2 will be compressed and oil will again be supplied to lubricant inlet 3 from both sources 11 and 14. If an oil restricter valve 27 is used, this valve will be moved to provide full oil flow through line 25 to the inlet 3.

The tank 11 is sized so that it is small in volume when compared with tank 14. This insures that the amount of air which must be vented to atmosphere during unloaded operation is kept at a minimum. As previously mentioned, this tank can be vented and pressurized almost instantaneously. Therefore, if it is an application where the compressor will be loaded and unloaded many times, greater savings will be realized.

The tank 11 is preferably sized and conduit 12 is located so that lubricant fills approximately one half of the tank. This sizing is believed to reduce the amount of oil foam which will be transferred to the surge tank via conduit 40 and valve 41 when the tank 11 is vented. The reduction in transfer of foam from tank 11 to surge tank 42 insures a more rapid venting of tank 11.

Referring to FIG. 2, there is shown a comparison of power input based upon power input to the motor driving the compressor to capacity output of the compressor. Ideally, a capacity control system might provide a straight line from a point where zero capacity output required zero power input to a point where 100% capacity output had 100% power input. Curve A represents the system of the present invention with a non-modulating or on-off intake regulator. Curve B represents a system using a slide valve for capacity control;

and curve C represents a compressor system using a modulating capacity control. Curve B does not extend to zero capacity since control is not usually obtainable by a slide valve. Curve A is almost a straight line and closely duplicates the ideal capacity control described above. The power savings which can be achieved by the present invention should be readily apparent from viewing FIG. 2.

From the foregoing it should be apparent that the objects of this invention have been carried out. An apparatus has been provided which controls the amount of lubricant supplied to the compressor during unloaded operation. This insures that an on-off intake regulator may be used and results in a greater power savings then with prior practice.

It is intended that the foregoing be merely a description of a preferred embodiment and that the invention be limited solely by that which is within the scope of the appended claims.

I claim:

1. In a gas compressor system including a screw type rotary gas compressor having an inlet for gas to be compressed, an inlet for lubricant and an outlet for compressed gas and lubricant, said gas compressor being operable in a loaded condition and in an unloaded condition, an improved system for supplying lubricant to said gas compressor comprising:

a first source of lubricant having pressurized and vented conditions flow connected to the outlet of the gas compressor;

a second source of lubricant adapted to be pressurized and flow connected to the first source of lubricant;

means for selectively supplying lubricant from said second source to the inlet for lubricant of the gas compressor;

means including a pump for continuously supplying lubricant from said first source to the inlet for lubricant of the gas compressor;

first valve means for venting said first source of lubricant to atmosphere when the gas compressor is being operated in an unloaded condition; and said means for selectively supplying lubricant from said second source including conduit means flow connecting said source with the inlet for lubricant of the gas compressor and second valve means in said conduit means for preventing lubricant from being supplied to said inlet for lubricant of the gas compressor from said second source when the gas compressor is being operated in an unloaded condition and permitting lubricant to be supplied to the inlet for lubricant from said second source when the gas compressor is being operated in a loaded condition;

said means from continuously supplying lubricant from said first source to the inlet for lubricant is flow connected to said conduit means flow connecting the said second source with the inlet for lubricant downstream, in the direction of lubricant flow, from said second valve means.

2. In a gas compressor system according to claim 1, wherein said first source of lubricant includes a gas-liquid reservoir tank and said second source of lubricant includes a gas-liquid reservior, said second source being flow connected to said first source at a location normally above the level of liquid in said first source and said first gas-liquid reservior tank is dimensioned so that it is about one half filled with liquid during normal operation of the gas compressor.

3. In a gas compressor system according to claim 2, the improved system for supplying lubricant further comprising a surge tank flow connected to said first valve means for removing lubricant which may be discharged from said first source of lubricant when said first source is vented, means flow connected to said surge tank for discharging compressed gas in said first source of lubricant and said surge tank to atmosphere when said first source of lubricant is vented and conduit means for supplying lubricant from said surge tank to the inlet for gas to be compressed of the gas compressor.

4. In a gas compressor according to claim 2, said means for selectively supplying lubricant from said second source to the inlet for lubricant further includes cooler means flow connected to said conduit means downstream of the point where said means for continuously supplying lubricant from said first source is flow connected to said conduit means for cooling all lubricant supplied to the inlet for lubricant of the compressor and means for sensing the temperature of the lubricant for controlling said means for cooling all lubricant.

5. In a gas compressor according to claim 4 wherein said conduit means includes an oil restrictor valve downstream in the direction of lubricant flow from the point where said means for continuously supplying lubricant from said first source is flow connected to said conduit means for permitting full flow of lubricant therethrough from both said first and second sources of lubricant when the gas compressor is being operated in a loaded condition and a partial flow of lubricant from the first source of lubricant when the gas compressor is being operated in an unloaded condition.

6. In a gas compressor system according to claim 5, the improved system for supplying lubricant further comprising a check valve flow positioned between said first source of lubricant and second source of lubricant for preventing said second source of lubricant from being vented when said first source of lubricant is vented.

* * * * *

UNITED STATES PATENT OFFICE

CERTIFICATE OF CORRECTION

PATENT NO. : 4,063,855

DATED : December 20, 1977

INVENTOR(S) : Kermit D. Paul

It is certified that error appears in the above-identified patent and that said Letters Patent are hereby corrected as shown below:

Column 6, line 27, "tube" should be --lube--.

Column 8, line 1, "from" should be --for--.

Signed and Sealed this

*Eleventh* Day of *April 1978*

[SEAL]

*Attest:*

RUTH C. MASON
*Attesting Officer*

LUTRELLE F. PARKER
*Acting Commissioner of Patents and Trademarks*